US012305543B2

(12) United States Patent
Kowalschek et al.

(10) Patent No.: US 12,305,543 B2
(45) Date of Patent: May 20, 2025

(54) SHIFT GATE, SLIDING CAM SYSTEM AND CAMSHAFT

(71) Applicants: thyssenkrupp Dynamic Components GmbH, Ilsenburg (DE); thyssenkrupp AG, Essen (DE)

(72) Inventors: Thilo Kowalschek, Chemnitz (DE); Sebastian Baer, Chemnitz (DE); Jens Schirmer, Chemnitz (DE); Mathias Roeder, Chemnitz (DE)

(73) Assignees: thyssenkrupp Dynamic Components GmbH, Ilsenburg (Harz) (DE); thyssenkrupp AG, Essen (DE)

( * ) Notice: Subject to any disclaimer, the term of this patent is extended or adjusted under 35 U.S.C. 154(b) by 0 days.

(21) Appl. No.: 18/694,748

(22) PCT Filed: Sep. 20, 2022

(86) PCT No.: PCT/EP2022/076081
§ 371 (c)(1),
(2) Date: Mar. 22, 2024

(87) PCT Pub. No.: WO2023/046672
PCT Pub. Date: Mar. 30, 2023

(65) Prior Publication Data

US 2024/0318582 A1 Sep. 26, 2024

(30) Foreign Application Priority Data

Sep. 23, 2021 (DE) ..... 10 2021 210 649.8

(51) Int. Cl.
*F01L 1/047* (2006.01)
*F01L 13/00* (2006.01)

(52) U.S. Cl.
CPC ..... *F01L 1/047* (2013.01); *F01L 13/0036* (2013.01); *F01L 2001/0473* (2013.01); *F01L 2013/0052* (2013.01); *F01L 2820/031* (2013.01)

(58) Field of Classification Search
CPC ..... F01L 1/047; F01L 2001/0473; F01L 13/0036; F01L 2013/0052; F01L 2820/031
(Continued)

(56) References Cited

U.S. PATENT DOCUMENTS 8,365,692 B2 2/2013 Schoeneberg et al.
2005/0011480 A1 1/2005 Schultz et al.
(Continued)

FOREIGN PATENT DOCUMENTS

DE 10 2012 213 863 A1 2/2014
DE 102012214389 A1 * 2/2014 ..... F01L 1/047
(Continued)

OTHER PUBLICATIONS

English Translation of International Search Report issued in PCT/EP2022/076081, dated Dec. 14, 2022.

*Primary Examiner* — Jorge L Leon, Jr.
(74) *Attorney, Agent, or Firm* — thyssenkrupp North America, LLC

(57) ABSTRACT

The present disclosure provides a shift gate for a sliding cam system with at least two shifting grooves for engaging at least one actuator pin. The shifting grooves extend in a circumferential direction of the shift gate. The two shifting grooves are at least partially separated from one another in an entry region of the actuator pin. In a transition region adjacent to the entry region, they converge on each other in such a manner that they merge into each other and form a common groove. The shifting grooves each comprise at least
(Continued)

one groove flank, in particular a lead flank and/or a runoff flank, which narrows the shifting grooves at least in the transition region, in such a manner that a groove width of the shifting grooves in the transition region is smaller than a groove width of the shifting grooves in the entry region of the actuator pin.

10 Claims, 3 Drawing Sheets

(58) Field of Classification Search
USPC ..... 123/90.18
See application file for complete search history.

(56) References Cited

U.S. PATENT DOCUMENTS

| | | | |
|---|---|---|---|
| 2011/0021463 | A1 | 1/2011 | Musson, IV |
| 2012/0222635 | A1 | 9/2012 | Sunada et al. |
| 2017/0248043 | A1 | 8/2017 | Kaan et al. |
| 2018/0094554 | A1 | 4/2018 | Kaan et al. |
| 2020/0003090 | A1 * | 1/2020 | Takada ..... F01L 1/185 |
| 2022/0341351 | A1 | 10/2022 | Weidauer |

FOREIGN PATENT DOCUMENTS

| | | | | |
|---|---|---|---|---|
| DE | 10 2012 218 803 | A1 | 4/2014 | |
| DE | 10 2014 017 036 | B3 | 3/2016 | |
| DE | 11 2009 005 395 | B4 | 11/2016 | |
| DE | 10 2017 103 104 | A1 | 8/2017 | |
| DE | 10 2020 100 196 | A1 | 7/2020 | |
| DE | 10 2019 125 100 | A1 | 3/2021 | |
| EP | 2 884 062 | A1 | 6/2015 | |
| JP | 2013-224588 | A | 10/2013 | |
| WO | 2014/059980 | A1 | 4/2014 | |
| WO | 2016/078751 | | 5/2016 | |
| WO | WO-2016078751 | A1 * | 5/2016 | ..... F01L 13/0036 |
| WO | 2016/177479 | A1 | 11/2016 | |
| WO | 2020/193560 | A1 | 10/2020 | |

* cited by examiner

SHIFT GATE, SLIDING CAM SYSTEM AND CAMSHAFT

CROSS REFERENCE TO RELATED APPLICATIONS

This application is a U.S. National Stage Entry of International Patent Application Serial Number PCT/EP2022/076081, filed Sep. 20, 2022, which claims priority to German Patent Application No. DE 10 2021 210 649.8, filed Sep. 23, 2021, the entire contents of which are incorporated herein by reference.

FIELD

The present disclosure generally relates to a shift gate, a sliding cam system, and a camshaft.

BACKGROUND

As a general rule, shift gates are used for the displacement or adjustment of sliding cam elements in variable valve control systems. Sliding cam elements with shift gates are therefore an important part of variable valve control in internal combustion engines. In essence, valve control systems of this kind can influence the valve lift movements of the intake and exhaust valves by changing the cam profiles or shut off valves by changing the cam profiles.

For the axial displacement of the sliding cam element, shift gates typically have shifting grooves. Shifting groove designs known in the art include, for example, S-grooves, double S-grooves, Y-grooves, and X-grooves. In order to displace the sliding cam element, the shifting grooves interact with an actuator that engages with the shifting groove with at least one actuator pin. In order to brake the displacement movement of the shift gate, stops are often provided that dissipate the braking forces that occur into the cylinder head cover. For example, a sliding cam system with an axial stop is known from the WO 2020/193 560 A1 referred to above, which is attributed to the applicant. Systems of this kind with axial stops reduce the space requirements but have permanently high frictional torques.

Frictional torque is reduced in systems without axial stops. However, these require an increased amount of space, leading to longer switching paths and thereby increasing the displacement forces. High displacement forces and the disadvantage that without axial stops sliding cam elements can overshoot beyond the end position can result in the actuator pin also having to brake the shift gate or the sliding cam element, resulting in a high braking contact force in the ejection area of the shift gate. This effect occurs primarily with widened grooves, since the track positions of the actuator pin vary greatly during insertion into the shifting groove for each displacement action. This also causes the brake contact positions of the actuator pin to vary greatly in the ejection area, resulting in significantly fluctuating braking forces for the actuator pin. Therefore, axial stops or, alternatively, very large actuator pin diameters are often used, particularly for small displacement ranges or high shifting speeds.

Thus a need exists for specifying a shift gate for a sliding cam system that has a reduced space requirement due to a simplified structural design, and reduces braking forces on an actuator pin during a displacement action. Furthermore, the invention is based on the object of specifying a sliding cam system and a camshaft.

DETAILED DESCRIPTION

Figure 1:
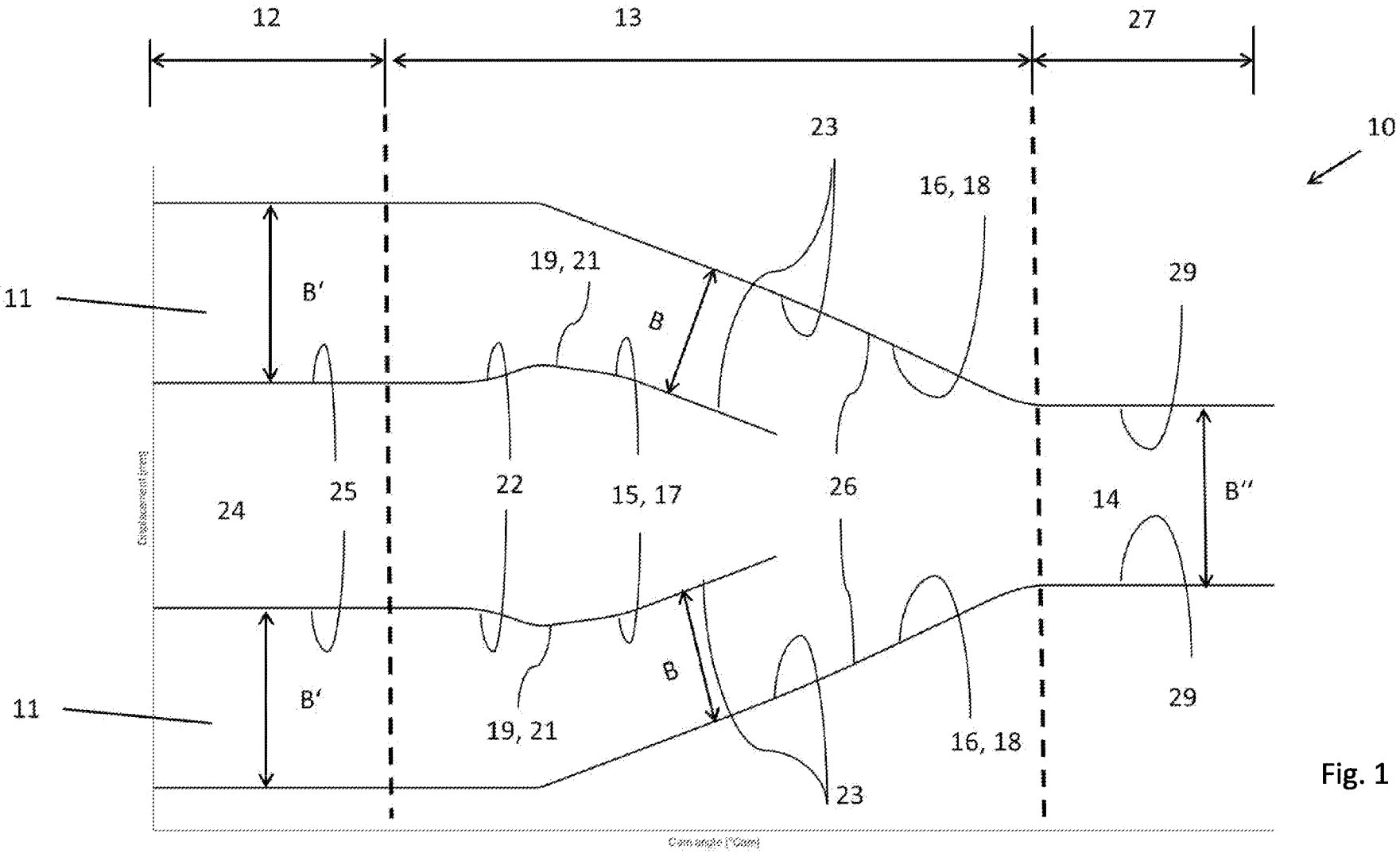
FIG. 1 is a diagram of a shift gate according an example of the present disclosure, wherein the diagram represents a partial detail of the profile of the shifting grooves as a function of the rotational angle.

Although certain example methods and apparatus have been described herein, the scope of coverage of this patent is not limited thereto. On the contrary this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure provides a shift gate for a sliding cam system with at least two shifting grooves for engaging at least one actuator pin, said shifting grooves extending in a circumferential direction of the shift gate, wherein the two shifting grooves are at least partially separated from one another in an entry region of the actuator pin, and in a transition region adjacent to the entry region, they converge on each other in such a manner that they merge into each other and form a common groove. The shifting grooves each comprise at least one groove flank, in particular a runoff flank and/or a lead flank, which narrows the shifting grooves at least in the transition region, in such a manner that a groove width of the shifting grooves in the transition region is smaller than a groove width of the shifting grooves in the entry region of the actuator pin.

The groove narrowing in the transition region of the shift gate results in a reduction of clearance between an engaging actuator pin and the groove walls or groove flanks of the respective shifting groove with respect to the groove width of the shifting groove in the entry region. This means that during a displacement action, the actuator pin is closely guided in the circumferential area by the groove wall or groove flank responsible for the displacement of the shift gate. This results in a continuous displacement movement and therefore a uniform displacement speed of the shift gate. The advantage of this is that, particularly in the area in which the two shifting grooves unite to form the common groove, the striking speed of the actuator pin on a side wall, in particular the braking flank, of the common groove is reduced. As a result, the braking forces on the actuator pin are reduced during a displacement action. The other significant advantage is that the shift gate can be braked in the displacement direction without the need for an additional stop. This results in the shift gate having a structurally simplified design. The share of the volume that needs to be machined is marginally reduced.

Preferably, in the transition region, the groove width of the shifting grooves is narrowed, in particular constricted, on the entry region side. In other words, the groove width of the shifting grooves is reduced in a portion of the shifting grooves adjacent to the entry region. The groove width of the shifting grooves is preferably narrowed in a transition between the entry region and the transition region.

The groove narrowing in the transition region of the shift gate has the further advantage that the area in which the actuator pin strikes the side wall of the common groove for braking is kept small, in particular is locally limited. In the case of shifting grooves known from the prior art, which also have an increased groove width in the transition region, an undesirably large movement space is available for the actuator pin, so that the stop position of the actuator pin on the side wall can vary along the common groove in a relatively large range. As a result of this, different braking forces can occur on the actuator pin during each displacement action. This complicates the design of the actuator pin, so that an axial stop for braking the shift gate in the displacement direction is frequently required.

Since the shift gate according to the invention reduces braking forces on the actuator pin, the braking of the shift gate is achieved by the actuator pin itself. In other words, an axial stop for braking the shift gate in the displacement direction is dispensed with. Due to the reduced braking forces, displacement actions are also possible with an increased rotational speed of the shift gate, low shifting ranges, and large groove widths of the entry region or the common groove, particularly of an exit area.

The entry region of the shift gate is the area that the actuator pin enters during a displacement action. The transition region is the area in which the two shifting grooves approach each other and merge into each other to form the common groove. In the transition region, the actuator pin interacts with at least one of the groove walls, in particular the groove flank, of the shifting groove for axial displacement of the shift gate. In the transition region, the shifting grooves run at least partially in a V-shape. The two shifting grooves and the common groove preferably form a Y-shaped shifting groove. In the entry region, the two shifting grooves are separated from one another in a longitudinal direction of the shift gate. In the entry region, the two shifting grooves preferably run parallel.

In the context of the invention, the groove width of the shifting grooves is understood to mean the width of the cross section of the shifting grooves in the respective area, in particular the entry region or transition region.

The shift gate is preferably part of a sliding cam element that has at least one cam for actuating or shutting off a valve. The shift gate can be integrally designed with the cam. It is possible for the shift gate to be designed as a separate part. The shift gate can be used as a separate part in this case and/or be part of a constructed sliding cam element. Other applications are possible.

Preferred embodiments of the invention are specified in the dependent claims.

In a preferred embodiment, the groove flank, in particular the runoff flank, converges towards another groove flank arranged opposite the groove flank, in particular the lead flank, of the shifting grooves at least partially in the transition region, in such a manner that during a displacement action, the actuator pin comes into contact with the other groove flank. In other words, the groove flank preferably extends at least partially in the direction of the other groove flank arranged opposite. The groove flank preferably has a profile that approximates to the other groove flank. The groove flank may run obliquely to the other groove flank, in order to reduce the groove width in the transition region. Or, in other words, the groove flank converges towards the other groove flank arranged opposite at least partially in a funnel-shaped manner. It is advantageous in this case that when the actuator pin makes contact with the groove flank, the shift gate is aligned in the displacement direction in the shifting groove in such a manner that it is guided towards the other groove flank. As a result of this, the shift gate is continuously moved in the displacement direction, i.e. free from any sudden acceleration in the displacement direction.

It is possible that, in addition, the other groove flank, in particular the lead flank, converges towards the groove flank, in particular the runoff flank, of the shifting grooves at least partially in the transition region. The other groove flank can therefore also be at least partially funnel-shaped.

The groove width of the shifting grooves is preferably limited, at least in the transition region, by the groove flank and the other groove flank arranged opposite the groove flank. The groove flank preferably limits the shifting grooves inwardly in a longitudinal direction of the shift gate. In addition or alternatively, the other groove flank preferably limits the shifting grooves outwardly in a longitudinal direction of the shift gate.

In another preferred embodiment, the groove flank has at least one narrowing portion that extends laterally into the shifting groove and reduces the groove width of the shifting groove at least in the transition region. In other words, the groove flank has a narrowing portion that preferably protrudes into the shifting groove at least partially. In the transition region, the narrowing portion is preferably arranged on the entry region side. The narrowing portion preferably extends at least partially along the shifting groove.

In concrete terms, the narrowing portion may extend partially along the shifting groove in the transition region or over the entire length of the shifting groove. The narrowing portion represents a sectional portion of the groove flank along the shifting groove. In other words, the reduction in the groove width of the shifting grooves occurs over a section f the shifting groove. This prevents sudden displacement movements of the shift gate. As a result of this, the displacement of the shift gate takes place in a uniform movement.

The narrowing portion of the groove flank preferably has at least one curvature that extends at least partially into the shifting grooves. The curvature may, in addition, include a smooth transition formed between the different groove widths of the shifting grooves in the entry region and in the transition region. The curvature is preferably an area curved towards the center of a shifting groove. The curvature preferably protrudes convexly into the shifting groove. In other words, the transition between the entry region and the transition region takes place continuously. Or, in other words, the transition between the entry region and the transition region is continuous. This has the advantage that the actuator pin is aligned in a uniform or smooth movement in the shifting groove and is guided towards the opposite groove flank.

In a preferred embodiment, the groove flank and the other groove flank have at least one parallel flank region relative to one another, which runs along the shifting grooves in the transition region in such a manner that the groove width is at least partially constant. The parallel flank region preferably abuts the narrowing portion. The parallel flank region keeps the reduced groove width constant along the shifting groove. This is beneficial to the uniform displacement movement of the shift gate.

In another preferred embodiment, at least one web is provided that is arranged in a longitudinal direction of the shift gate between the two shifting grooves, wherein the groove flank, in particular the runoff flank, of the shifting grooves is part of the web. The web partially separates the two shifting grooves in the circumferential direction. The web preferably extends in the circumferential direction and terminates in the area in which the two shifting grooves merge into one another to form the common shifting groove. The groove flank narrowing the groove width is preferably a side wall of the web that limits the shifting groove at least in the transition region. In other words, the groove flank preferably forms a side wall of the web facing the respective shifting groove. Particularly preferably, the web has two of the groove flanks which are formed on both sides of the web transversely to the circumferential direction. In this embodiment, the web actively engages in the displacement action of the shift gate.

The groove flank may be part of at least one outer wall that outwardly delimits the shifting grooves in a longitudinal direction of the shift gate. Alternatively or in addition, an outer wall outwardly delimiting the shifting grooves axially can thereby form the groove flank. In this way, an improved effect can be achieved when aligning the actuator pin position in the shifting groove.

According to a secondary aspect, the invention relates to a sliding cam system with at least one sliding cam element, at least one multiple-pin actuator, in particular a double-pin actuator, wherein the sliding cam element has at least one shifting groove according to the invention, wherein one of the shifting grooves of the shift gate interacts with at least one actuator pin of the multiple actuator during a displacement action of the sliding cam element.

According to another secondary aspect, the invention relates to a camshaft with at least one shift gate according to the invention and/or at least one sliding cam system of the aforementioned kind.

With regard to the sliding cam system and the camshaft, reference is made to the advantages explained in connection with the shift gate. Furthermore, the sliding cam system and the camshaft may have, alternatively or in addition, individual features referred to previously in relation to the shift gate, or a combination of multiple features.

The invention will be explained in greater detail below with further details with reference to the accompanying drawings. The illustrated embodiments are examples of how the shift gate according to the invention can be configured.

Figure 2:
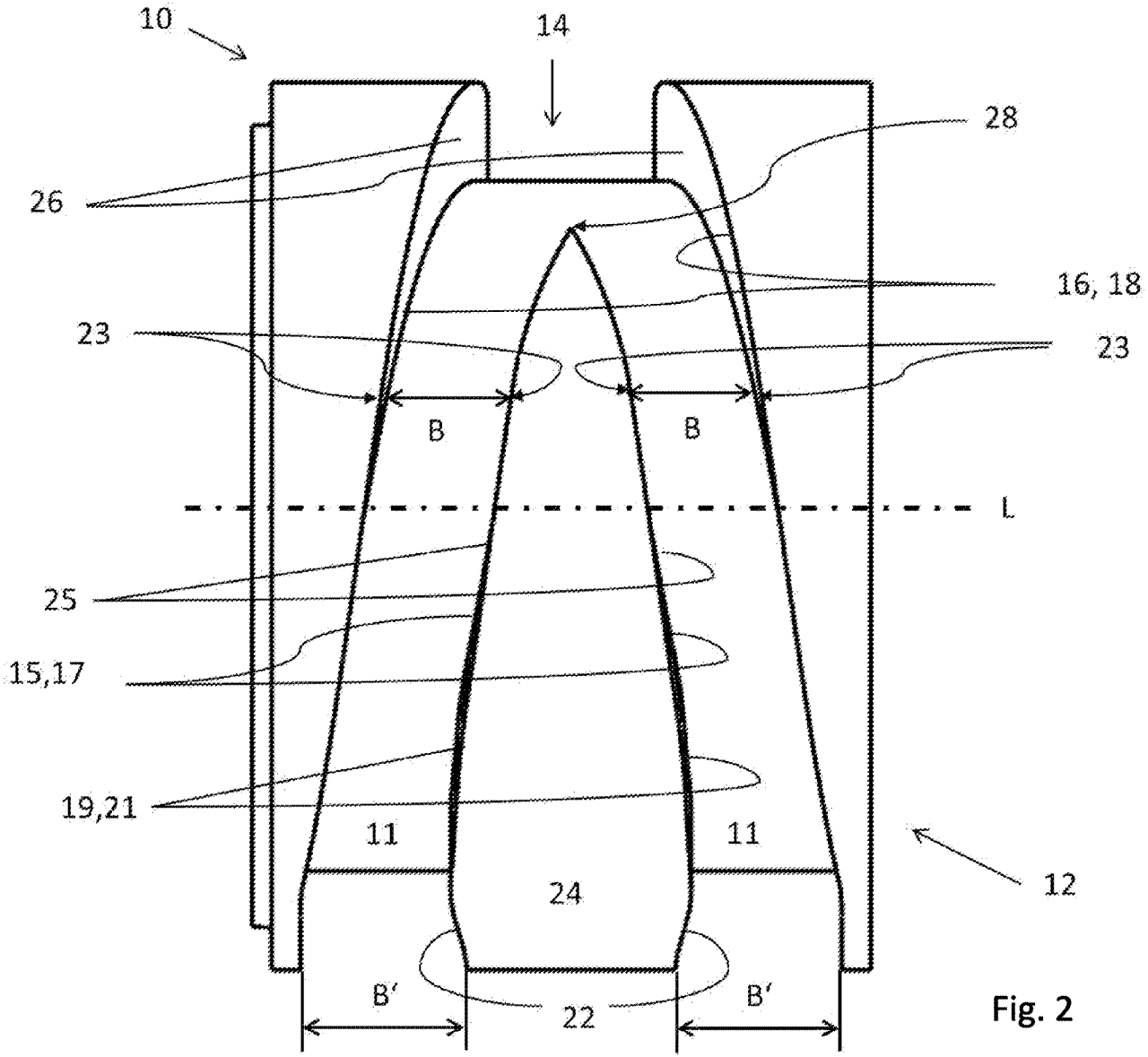
FIG. 2 is a top view of a transition region of the shift gate according to FIG. 1, in which the shifting grooves approach one another.
Figure 3:
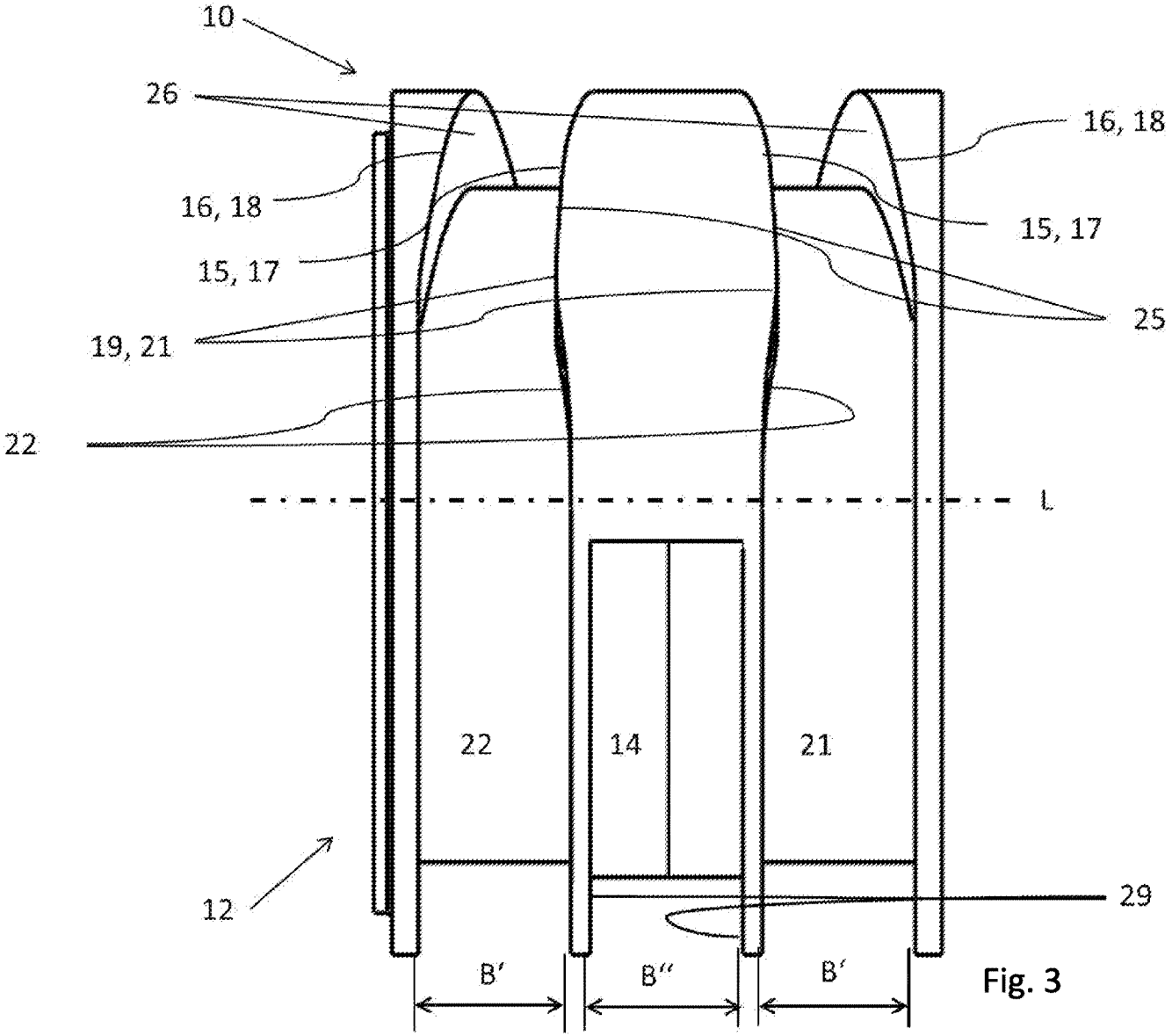
FIG. 3 is a top view of an entry or exit area of the shift gate according to FIG. 1.

FIGS. 1 to 3 show a shift gate 10 according to a preferred exemplary embodiment according to the invention. In concrete terms, FIG. 1 shows a diagram of a shift gate 10 according to an exemplary embodiment according to the invention. The diagram depicts a partial detail of the course of the shift gate 10, wherein a part of an entry region 12, a transition region 13, and a part of an exit region 27 of the shift gate 10 are shown. FIGS. 2 and 3 each show the shift gate 10 in a different rotational position around its longitudinal axis L.

The shift gate 10 according to FIGS. 1 to 3 may be part of a sliding cam element that has at least one cam for actuating or shutting off a valve. The shift gate 10 can be integrally designed with the cam. It is possible for the shift gate 10 to be designed as a separate part. The shift gate 10 can be used as a separate part in this case and/or be part of a constructed sliding cam element. Other applications are possible.

As shown in FIGS. 1 to 3, the shift gate 10 has two shifting grooves 11 that extend in a circumferential direction of the shift gate 10. The shift gate 10 comprises, as already mentioned above, an entry region 12, an exit region 27, and a transition region 13 arranged therebetween in the circumferential direction. The transition region 13 abuts the entry region 12 and the exit region 27 in the circumferential direction. The entry region 12 and the exit region 27 partially overlap in the circumferential direction. This can be clearly seen in FIG. 3.

The two shifting grooves 11 extend completely through the entry region 12. The two shifting grooves 11 run parallel in the entry region 12. In addition, the two shifting grooves 11 are spaced apart from one another in the longitudinal direction, i.e. transversely to the circumferential direction of the shift gate 10. In concrete terms, a web 24 that inwardly delimits the two shifting grooves 11 in the longitudinal direction is arranged between the two shifting grooves 11. The web 24 will be discussed in greater detail later.

The shifting grooves 11 are used to engage an actuator pin that is not shown, in order to move the shift gate 10 in a displacement direction. The displacement direction runs transversely to the circumferential direction. In other words, the displacement direction runs parallel to the longitudinal axis L of the shift gate 10. The entry region 12 is the region in the circumferential direction in which an actuator pin enters one of the two shifting grooves 11 during a displacement action. In a state inserted into the shifting groove 11, the actuator pin radially protrudes into the shifting groove 11.

It is shown in FIGS. 1 and 2 that the two shifting grooves 11 converge with one another in the transition region 13, in such a manner that they merge into one another to form a common groove 14. In other words, the two shifting grooves 11 converge in the transition region 13 in a V-shaped manner. The grooves 11, 14, form a Y-shaped shifting groove with the profile thereof. The common groove 14 is designed running parallel to the two shifting grooves 11. The common groove 14 passes through the exit region 27. The common groove 14 and the web 24 are located at the same axial position along the longitudinal axis L of the shift gate 10. The common groove 14 and the web 24 are arranged substantially halfway along the shift gate 10.

According to FIG. 3, starting from the transition region 13, the common groove 14 runs in an ascending manner in the circumferential direction towards the web 24. The common groove 14 is designed in a continuously, particularly radially, ascending manner in the circumferential direction, and opens onto a circumferential surface of the web 24.

The exit region 27 is the region in which the actuator pin exits the common groove 14 following the displacement of the shift gate 10. The common groove 14 forms an ejection ramp for the actuator pin in this case. In the state in which it has exited the common groove 14, the actuator pin is received by an actuator, in particular a multiple-pin actuator. In the exited state, the actuator pin is spaced apart from the shift gate 10, so that it does not come into contact with the shift gate 10.

The shifting grooves 11 have a groove width B in the transition region 13 that is smaller than a groove width B' of the shifting grooves 11 in the entry region 12. This is particularly evident in FIGS. 1 and 2. Furthermore, FIG. 1 shows that a groove width B" of the common groove 14 is greater than the groove width B of the shifting grooves 11.

The groove width B, B', B" of the grooves 11, 14 is the width of the cross section of the grooves 11, 14 at the respective cross-sectional position. In the entry region 12, the groove width B' of the shifting grooves 11 is constant. In the transition region 13, the shifting grooves 11 have a reduced groove width B in relation to the groove width B' in the entry region 12. In other words, the shifting grooves 11 are narrowed in the transition region 13. To achieve this, the web 24 has two groove flanks 15, wherein one of the groove flanks 15 in each case abuts one of the shifting grooves 11 on the inside transversely to the circumferential direction. The groove flanks 15 each form a sidewall 25 of the web 24. The groove flanks 15 converge towards a pointed end 28 of the web 24. The groove flanks 15 are referred to as runoff flanks. The groove flanks 15 will be dealt with in greater detail later.

Furthermore, the shifting grooves 11 comprise two other groove flanks 18 that abut the shifting grooves 11 on the outside in the longitudinal direction of the shift gate 10. The other groove flanks 18 are part of outer walls 26 of the shift gate 10. The other groove flanks 18 are referred to as lead flanks. A groove flank 15 in each case is arranged opposite another groove flank 18. The groove width B of the shifting grooves 11 corresponds to the distance between the groove flank 15 and the other groove flank 18 which is opposite. The distance corresponds to the cross-sectional width of the shifting grooves 11. In other words, the groove flank 15 and the other groove flank 18 lying opposite define the groove width B of the shifting grooves 11.

In the transition region 13, the groove flank 15 in each case, in particular the runoff flank 17, partially converges towards the other groove flank 18 arranged opposite, in particular the lead flank 16, of the respective shifting groove 11, in such a manner that during a displacement action, the actuator pin comes into contact with the other groove flank 18. The groove flank 15 converges towards the other groove flank 18 in the transition region 13 in a funnel-shaped manner.

The respective groove flank 15 comprises at least one narrowing portion 19 that extends laterally into the shifting groove 11 and reduces the groove width B' of the shifting groove 11 of the entry region 12 to the groove width B of the shifting groove 11 in the transition region 13. The narrowing portion 19 of the groove flank 15 comprises at least one curvature 21 that projects into the shifting groove 11 in sections. The curvature 21 has a convex design and extends laterally into the shifting groove 11. In other words, the narrowing portion 19 comprises a protuberance that extends into the shifting groove 11.

Furthermore, the narrowing portion 19 of the groove flank 15 has a smooth transition 22 between the different groove widths b, b' of the shifting groove 11 in the entry region 12 and in the transition region 13. In other words, the shifting groove 11 with the groove width b' transitions smoothly in the entry region 12 to the shifting groove 11 with the groove width b in the transition region 13.

The narrowing portion 19 of the respective groove flank 15 is formed in sections in the transition region 13 along the respective shifting groove 11. The narrowing portion 19 is arranged on the entry region side in the transition region 13. Adjacent to the narrowing portion 19 is a parallel flank region 23 of the groove flank 15 and the other groove flank 18. The parallel flank region 23 runs along the shifting groove 11 towards the pointed end 28 of the web 24, in such a manner that the groove width B is constant in this portion. This is clearly visible in FIGS. 1 and 2.

The following describes a displacement action of the shift gate 10 in the displacement direction, i.e. along the longitudinal axis L.

During a displacement action of the shift gate 10, an actuator pin of an actuator, in particular double-pin actuator, enters one of the shifting grooves 11 in the entry region 12. The shift gate 10 rotates about its longitudinal axis l in this case. In the entry region 12, the shifting groove 11 has a groove width b' that is of a corresponding size in relation to a diameter of the actuator pin, so that a collision with one of the groove flanks 15, 18 is prevented. The actuator pin is located in the entry region 12 in the shifting groove 11 at an off-center track position. Due to the narrowing portion 19 of the groove flank 15 of the web 24, the shift gate 10 is shifted in the transition region 13 on the entry region side, in such a manner that the actuator pin comes into contact with the other groove flank 18.

The actuator pin cooperates with the other groove flank 18 in such a manner that the shift gate 10 is displaced in the displacement direction. The displacement movement of the gate 10 ends when the two shifting grooves 11 merge into the common groove 14. The actuator pin enters the common groove 14 in the exit region 27 and abuts a braking flank 29, in particular a sidewall, of the common groove 14. The actuator pin is then ejected by the ascending common groove 14, i.e. radially extended from the common groove 14. The displacement action of the shift gate 10 is complete. Another displacement action can be carried out in the opposite displacement direction.

LIST OF REFERENCE SIGNS

10 shift gate
11 shifting grooves
12 entry region
13 transition region
14 common groove
15 groove flank
16 entry flank
17 runoff flank
18 other groove flank
19 narrowing portion
21 curvature
22 transition
23 parallel flank region
24 web
25 sidewall
26 outer wall
27 exit region
28 pointed end
29 braking flank
B groove width of the shifting grooves in the transition region
B groove width of the shifting grooves in the entry region
B" groove width of the shifting grooves in the exit region
L longitudinal axis of the shift gate

What is claimed is:

1. A shift gate for a sliding cam system, the shift gate comprising:

a sliding cam defining at least two shifting grooves extending in a circumferential direction of the sliding cam so as to engage at least one actuator pin, the at least two shifting grooves including:

an entry region, for receiving the at least one actuator pin, in which the at least two shifting grooves are separated from each other via a web, and a transition region, adjacent to the entry region, in which the at least two shifting grooves converge on each other so as to form a common groove; and wherein each shifting groove includes a lead flank and a runoff flank which narrow the shifting groove in the transition region such that a first groove width of the shifting groove in the entry region is greater than a second groove width of the shifting groove in the transition region;

wherein the runoff flank of each shifting groove includes a narrowing portion extending laterally from the web into the shifting groove so as to define the second groove width of the shifting groove in the transition region.

2. The shift gate of claim 1, wherein in each shifting groove, the runoff flank at least partially converges towards the lead flank in the transition region such that the at least one actuator pin comes into contact with the lead flank during a displacement action.

3. The shift gate of claim 1 wherein the narrowing portion of each runoff flank includes at least one curvature partially extending into the shifting groove so as to form a smooth transition from the first groove width to the second groove width.

4. The shift gate in of claim 1 wherein the narrowing portion of each runoff flank is at least partially formed in the transition region.

5. The shift gate of claim 1 wherein each shifting groove further includes at least one parallel flank area in which the lead flank and the runoff flank run parallel to each other in the transition region.

6. The shift gate of claim 1 wherein the runoff flank of each shifting groove is defined by a respective sidewall of the web.

7. The shift gate of claim 6 wherein in each shifting groove, the lead flank defines an outer wall which cooperates with the runoff flank so as to delimit the shifting groove.

8. A camshaft including at least one shift gate according to claim 1.

9. A sliding cam system comprising:

at least one multiple-pin actuator; and at least one sliding cam element including at least one shift gate according to claim 1, wherein one shifting groove of the at least two shifting grooves of the at least one shift gate engages at least one actuator pin of the at least one multiple-pin actuator during a displacement action of the at least one sliding cam element.

10. The sliding cam system of claim 9 wherein the at least one multiple-pin actuator is a double-pin actuator.

* * * * *